United States Patent [19]

Beshore

[11] 4,036,197

[45] July 19, 1977

[54] AUTOMOTIVE IGNITION DISTRIBUTOR CONVERSION MEANS

[76] Inventor: Craig S. Beshore, 753 Puma Canyon Lane, Glendora, Calif. 91740

[21] Appl. No.: 628,415

[22] Filed: Nov. 3, 1975

[51] Int. Cl.[2] ..... F02P 7/02

[52] U.S. Cl. ..... 123/146.5 A; 200/29

[58] Field of Search ..... 123/148 E, 148 R, 146.5 A; 200/19 R, 19 A, 22, 25, 27 A, 29, 30 A, 30 AA, 31 A, 31 R; 250/233

[56] References Cited

U.S. PATENT DOCUMENTS

| | | | |
|---|---|---|---|
| 2,032,187 | 2/1936 | Sorensen | 200/19 A |
| 3,249,707 | 5/1966 | Johnson et al. | 310/70 R X |
| 3,272,930 | 9/1966 | Frank | 123/146.5 R X |
| 3,510,609 | 5/1970 | Cooksey | 200/19 A |
| 3,660,622 | 5/1972 | Machado | 200/19 A |
| 3,660,623 | 5/1972 | Bevacqua | 123/148 E X |
| 3,710,131 | 1/1973 | Ford | 123/148 E X |
| 3,807,378 | 4/1974 | Wernet, Jr. | 123/148 E |
| 3,906,920 | 9/1975 | Hemphill | 123/146.5 A X |
| 3,931,804 | 1/1976 | Bowen | 123/148 E |

OTHER PUBLICATIONS

"An All Electronic Ignition System" by George Hughes, *Electronics Austrailia,* Sept. 1970, vol. 32, No. 6.

*Primary Examiner*—Ronald H. Lazarus
*Assistant Examiner*—Tony M. Argenbright
*Attorney, Agent, or Firm*—Boniard I. Brown

[57] ABSTRACT

Automotive ignition distributor conversion means, comprising an ignition timing rotor and an ignition timing detector mounting bracket, for converting a conventional automotive spark ignition engine distributor to an electronic ignition distributor adapted for use with an electronic ignition system. The conversion means are adapted for retro-fit installation on virtually all makes of automotive vehicles.

13 Claims, 11 Drawing Figures

AUTOMOTIVE IGNITION DISTRIBUTOR CONVERSION MEANS

BACKGROUND OF THE INVENTION

1. Field of the Invention

This invention relates generally to automotive spark ignition engines and more particularly to universal retro-fit ignition distributor conversion means for converting a conventional automotive spark ignition engine distributor to an electronic ignition distributor for use with an electronic ignition system.

2. Discussion of the Prior Art

Automotive ignition systems, both conventional breaker point type and electronic ignition systems, are well understood by those versed in the automotive field and hence need not be described in great detail in this disclosure which is concerned primarily with the ignition distributor. Suffice it to say that the ignition distributor of both conventional and electronic ignition systems performs two switching functions in timed relation to the reciprocating motion of the engine pistons to effect firing of the cylinder spark plugs in the proper timing relative to the piston motion. One of these switching functions accomplishes periodic charging of the ignition coil to periodically develop a high tension voltage across the output terminals of the coil. The second switching function accomplishes application of this periodic coil voltage to the cylinder spark plugs in a predetermined sequence of firing order. In a conventional distributor, the first switching function is performed by breaker points which are actuated by a cam on the distributor rotor and shunted by a condenser whose purpose is to prevent arcing across and thereby rapid degradation of the points. In an electronic ignition system, on the other hand, the first switching function is performed by an electronic ignition circuit which is electronically switched or triggered between conducting and non-conducting states.

The advantages of an electronic ignition system over a conventional ignition system are many and well known to those versed in the automotive field and hence need not be elaborated on. Suffice it to say that these advantages have prompted the development of a variety of electronic ignition systems and ever increasing usage of such systems.

The existing electronic ignition systems utilize a variety of distributor arrangements for triggering the electronic ignition circuit between its conducting and non-conducting states in the proper timing relative to the reciprocating motion of the engine pistons. This invention is concerned with electronic ignition distributors of type having a disk-like ignition timing rotor mounted on the distributor shaft for rotation with the shaft and provided about its circumference with uniformly spaced ignition timing elements equal in number to the engine cylinders and a timing element detector mounted on the distributor body in timing element sensing relation to the rotor.

During engine operation, the timing elements rotate in succession past the detector in timed relation to the reciprocating motion of the engine pistons, and the detector senses and provides an electrical output pulse in response to each timing element. These timing pulses from the detector trigger the electronic ignition circuit between its conducting and non-conducting states to effect periodic charging of the ignition coil. The resulting periodic high tension voltage developed across the coil is applied to the cylinder spark plugs in the proper firing order by the high tension switching element of the distributor. The timing element detector is positioned relative to the distributor body such that the spark plugs are fired in the proper timing relative to the reciprocating motion of the engine pistons.

SUMMARY OF THE INVENTION

This invention provides universal retro-fit distributor conversion means for converting a conventional breaker point type spark ignition engine distributor to an electronic ignition distributor for use in an electronic ignition system of the kind described above. This conversion means comprises, collectively and individually, an ignition timing rotor to be mounted on the breaker point cam of a conventional distributor and a mounting bracket for the ignition timing detector. The timing rotor has a unique segmental construction and cam bearing spring arrangement which adapt the rotor for installation on the distributor cam of virtually any make of automotive vehicle. Above the circumference of this rotor are ignition timing elements to be sensed by the timing element detector of the electronic ignition system.

The mounting bracket of the present distributor conversion means is adapted to mount the detector on the distributor body. This mounting bracket is uniquely constructed and arranged to provide three way adjustment of the detector relative to the timing rotor, namely adjustment axially, radially, and circumferentially of the rotor, to locate the detector in the proper timing element sensing relation to the rotor and at the proper position about the rotor to effect firing of the engine spark plugs in the correct timing relative to the reciprocating motion of the engine pistons.

DESCRIPTION OF THE PREFERRED EMBODIMENT

Figure 1:
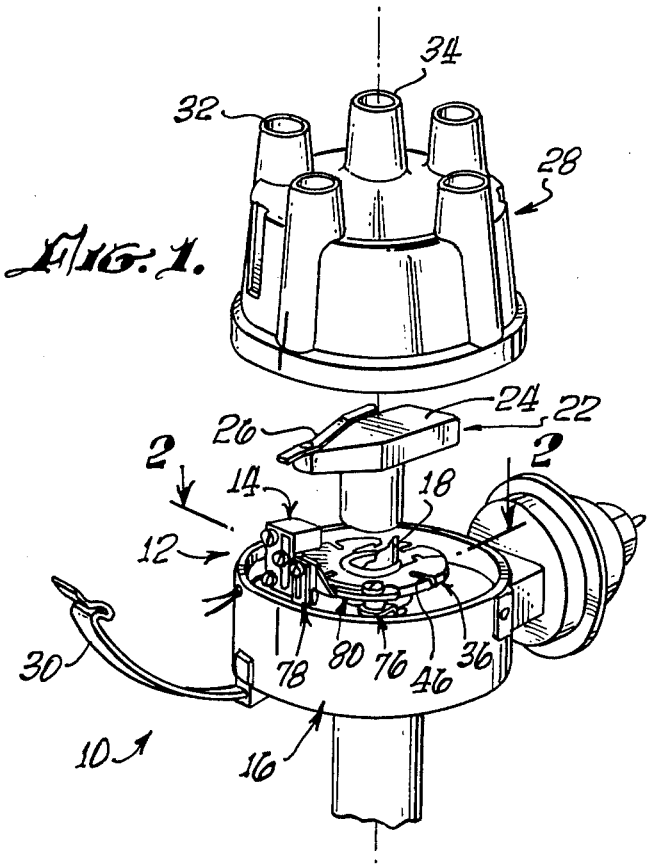
FIG. 1 is an exploded perspective illustrating distributor conversion means according to the invention installed on a conventional carburetor.
Figure 3:
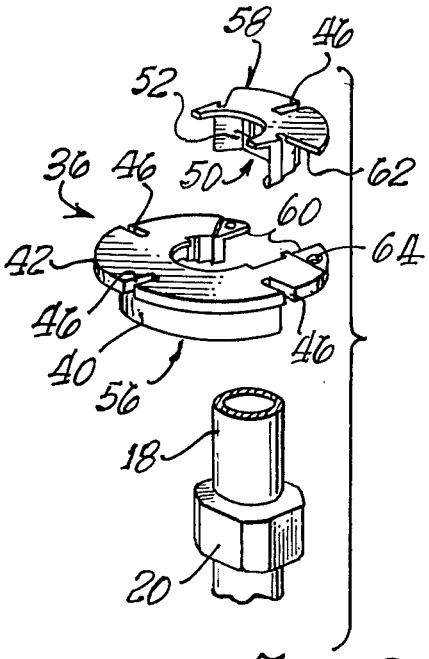
FIG. 3 is an enlarged exploded perspective view of the timing rotor of the present distributor conversion means and the distributor cam on which the rotor is mounted.
Figure 4:
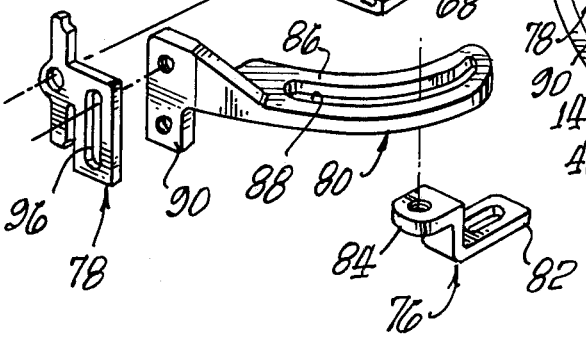
FIG. 4 is an enlarged exploded perspective view of the timing rotor detector and detector mounting bracket of the present distributor conversion means.
Figure 2:
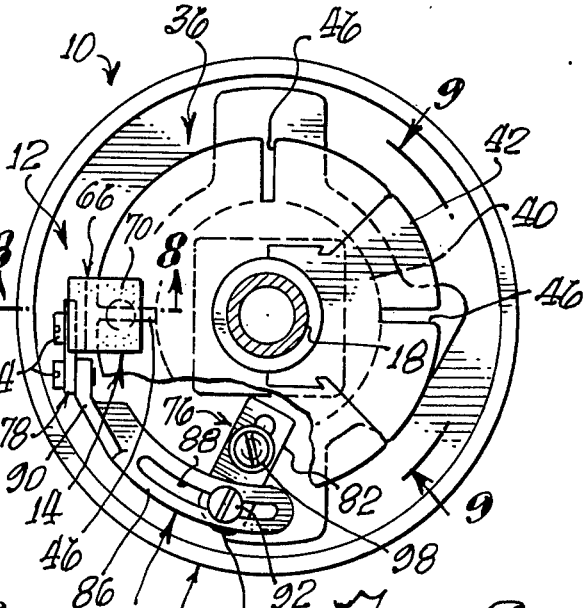
FIG. 2 is an enlarged view taken on line 2—2 in FIG. 1.
Figure 5:
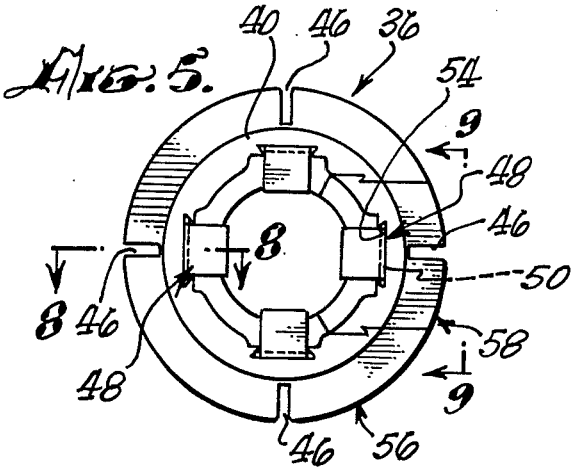
FIGS. 5 through 7 illustrate timing rotor configurations for 4, 6 and 8 cylinder engines, respectively.

Referring first to FIGS. 1-3, reference numeral 10 denotes a spark ignition engine distributor on which is installed distributor conversion means 12 according to this invention. The distributor 10, excluding the conversion means 12, is a conventional breaker point type spark ignition engine distributor with the breaker points and condensor removed. The conversion means 12 is installed on the distributor to convert the latter to an electronic ignition distributor suitable for use with an electronic ignition system of the kind having an ignition circuit which is triggered between its conducting and non-conducting states by pulses from a timing detector, indicated at 14, as explained in more detail later.

Figure 6:
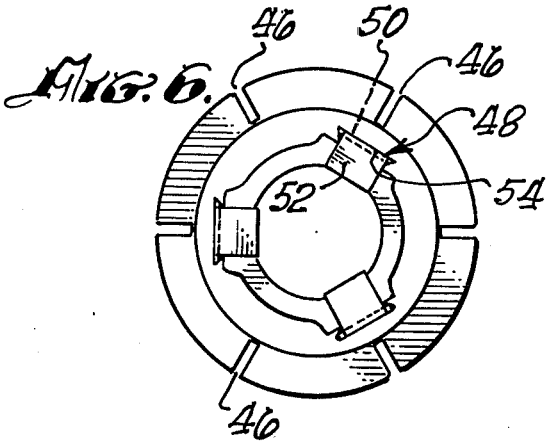
Figure 9:
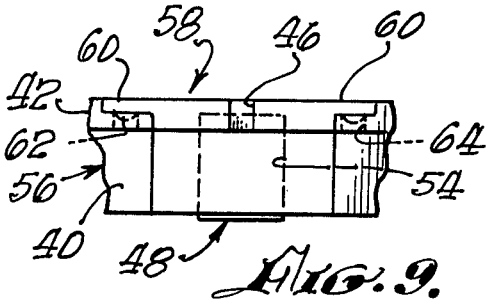
FIG. 9 is a enlarged view taken on line 9—9 in FIG. 2.
Figure 7:
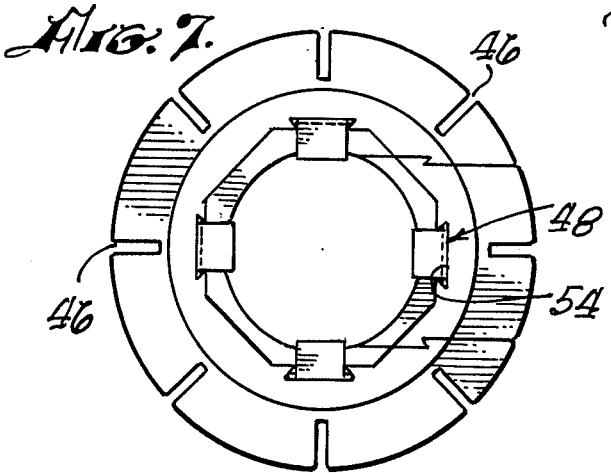

Since the basic distributor 10 is conventional, it is necessary to describe the distributor only in sufficient detail to enable full and clear understanding of the present invention. With this in mind, the distributor comprises a body 16 mounting a rotor shaft 18 which is geared to the engine crankshaft (not shown) for rotation in unison with the crankshaft and thereby in timed relation to the reciprocating motion of the engine pistons (not shown). Integrally formed on the rotor shaft 18 is a cam 20 which in the conventional distributor, actuates the distributor breaker points to periodically open and close the energizing circuit for the engine ignition coil (not shown) in the proper timing relative to the reciprocating piston motion. As noted, these breaker points are removed from the distributor shown. The particular distributor cam 20 shown is a four sided cam for a four cylinder engine. Six and eight cylinder engines will have six and eight sided distributor cams, as shown in FIGS. 6 and 7. Mounted on the upper end of the rotor shaft 18 is a high tension rotor 22 having an upper transverse arm 24 terminating in a high tension wiper contact 26.

In the normal operating condition of the distributor 10, a distributor cap 28 is attached by spring catches 30 (only one shown) to the upper side of the distributor body 16. This cap encloses the distributor rotor 22 and cam 20, as well as the conversion means 12 of this invention. Circumferentially spaced about the cap 28 are sockets 32 for receiving electrical cables leading to the engine spark plugs. At the center of the cap is a socket 34 for receiving the high tension lead of the ignition system.

When the distributor cap 28 is installed on the distributor body 16, the inner end of the contact 26 on the high tension rotor arm 24 engages a contact button (not shown) on the inner side of the cap which is electrically connected to the high tension socket 34. As the rotor turns, the outer end of the rotor contact 26 wipes across contact buttons (not shown) on the inside of the distributor cap electrically cnnected to the spark plug cable sockets 32, respectively, for applying the high tension voltage to the spark plugs in the proper firing order.

The distributor 10 described to this point is conventional except for the conversion means 12. The conversion means will now be described by reference to FIGS. 1–9. Generally speaking, the conversion means comprises an ignition timing rotor 36 to be mounted on the distributor rotor shaft 18, and more specifically on the shaft cam 20, for rotation with the shaft and a mounting bracket 38 for the detector 14.

Ignition timing rotor 36 comprises a cylindrical hub 40 and an outwardly directed annular flange 42 rigid on one end of the hub. Spaced about the circumference of the rotor flange 42 are a plurality of ignition timing elements 46 equal in number to the cylinders of the engine on which the distributor is used and hence to the number of sides on the distributor cam 20. Thus, the particular distributor shown is designed for use on a four cylinder engine. As will appear from the ensuing description, a variety of timing elements may be utilized on the timing rotor. The particular timing elements shown are radial slots in the rotor flange.

Figure 8:
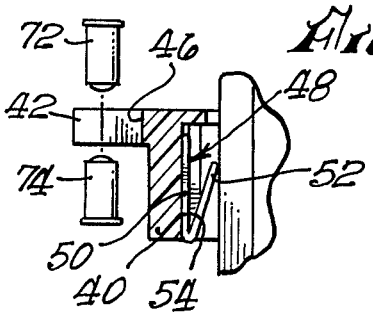
FIG. 8 is an enlarged fragmentary section taken on line 8—8 in FIG. 2.

As noted above, the timing rotor 36 is intended to be mounted on the cam 20 of the distributor rotor shaft 18. To this end, the opening through the rotor is sized to receive the cam with sufficient clearance, as shown in FIG. 8, to accommodate the cams of virtually all makes of automotive vehicles as well as the manufacturing tolerances of the cams. The rotor is secured to the cam for rotation therewith by spring clips 48 about the wall of the opening through the rotor which bear against the flat sides of the cam. Each spring clip is bent into a V-shape and has normally outer and inner arms 50, 52 joined at one end. The outer arm 50 of each clip is slidably fitted within an undercut groove or mortise 54 in the wall of the opening through the timing rotor with the apex of the clip at the normally lower end of the opening. The inner cam 52 of each clip inclines inwardly toward the axis of the rotor opening for contact with the distributor cam 20, as shown best in FIG. 8.

It will be understood that the spring clips 48 are equal in number to the flat sides of the cam and are circumferentially spaced about the timing rotor opening to be located opposite these cam sides when the rotor is positioned on the cam. The radially inward extension of the inner clip arms 52 in their normal unstressed condition is such that the arms are deformed or bent outwardly when the rotor is positioned on the cam, whereby the arms press firmly against the cam faces to firmly retain the timing rotor on the cam. The spring clips being yieldable, of course, permits the timing rotor to accommodate itself to the manufacturing tolerances of different cams.

The timing rotor 36, being positioned on the distributor shaft cam 20 as it is, is located below the high tension rotor 22. If this high tension rotor is removable from the distributor shaft 18, as it is in many automotive vehicles, it will not interfere with placement of the timing rotor on the distributor cam. Thus, the timing rotor may be placed on the cam by first removing the high tension rotor and then simply sliding the timing rotor downwardly over the distributor shaft and cam.

In some cases, however, the high tension rotor is not removable. In order to permit installation of the timing rotor on a distributor whose high tension rotor is not removable, the present timing rotor is provided with two separable sections 56 and 58, as shown best in FIG. 3. The larger rotor section 56 has a generally C-shaped configuration, such that it may be inserted laterally about the distributor shaft 18 and cam 20. The smaller rotor section 58 is then fitted to the larger section to complete the timing rotor. The larger rotor section has apertured recessed flange portions 60 on which the smaller rotor section rests and to which the smaller section is secured by studs 62 entering the holes 64 in the flange portions 60.

The timing detector 14 is conventional and, during engine operation, senses the timing elements 46 on the timing rotor 36 as the latter turns and provides timing pulses which triggers the electronic ignition system (not shown) to fire the engine spark plugs in the proper timing. The detector shown is a photo electric detector for sensing the timing rotor timing slots 46. This detector has a generally C-shaped body 66 including arms 68, 70 for straddling the timing rotor flange 42. One arm carries a light source 72 (FIG. 8), such as a light emitting diode, and the other arm carries a light detector 74, such as a photo transistor. Accordingly, rotation of each timing rotor slot 46 between the source 72 and detector 74 causes the latter to produce an electrical output pulse for triggering the electronic ignition circuit.

The present mounting bracket 38 is designed to support the timing element detector 14 in timing element sensing relation to the timing rotor 36 and at the proper position about the rotor to effect proper timing of the pulses from the detector. This bracket will now be described with particular reference to FIG. 4.

Generally speaking, the detector mounting bracket 38 comprises a relatively fixed base part 76 for attachment to the distributor body 16, an adjustble part 78 for mounting the detector 14, and means 80 adjustably mounting the bracket part 78 on the fixed bracket part 76 for adjustment relative to the latter part. This bracket adjustment is such that when installed on the distributor body 16, the detector 14 is adjustable axially, radially, and circumferentially of the timing rotor 36 to locate the detector in proper sensing position relative to the rotor.

The bracket base part 76 has a generally Z-shape and includes a lower mounting flange 82 which is slotted to receive a bolt for attaching the part to the distributor body 16 and an upper support flange 84. The adjustable bracket means 80 comprises a generally circularly curved arm 86 having a similarly curved longitudinal slot 88 extending the major length and to one end of the arm. Rigid on the opposite end of the arm is a flange 90 normal to the plane of the arm. Arm 86 is attached by a bearing screw 92 to the upper support flange 84 of the bracket base part 76 for endwise adjustment of the arm along a curved direction line, i.e., the curved longitudinal axis of the arm slot 88, relative to the base part and pivotal adjustment of the arm relative to the base part about the axis of the screw 92. Bracket part 78 is attached to the arm flange 90 by a screw 94 which passes through a slot 96 in the part 78 to permit adjustment of the latter part relative to the bracket arm 86 in a direction normal to the plane of the arm and parallel to the pivot axis of the arm about the bearing screw 92. Detector 14 is bolted to the bracket part 78, as shown.

The detector mounting bracket 38 is installed on the distributor body 16, in the position shown best in FIGS. 1 and 2, by inserting a screw 98 through the slot in the bracket base part mounting flange 82 and threading the screw into one of the screw holes left vacant by removal of the breaker points and condensor of the conventional carburetor. When thus installed, the axis of the bracket arm bearing screw 92, about which the bracket arm 86 is pivotally adjustable, parallels the turning axis of the timing rotor 36. From the foregoing description of the bracket, it will be understood that with the bracket mounted on the distributor body, the detector 14 is adjustable radially, axially, and circumferentially of the timing rotor 36. Thus, the detector is adjustable radially of the timing rotor by pivotal adjustment of the bracket arm 86 about its bearing screw 92. The detector is adjustable circumferentially of the rotor by endwise adjustment of the bracket arm relative to the bracket base part 76. Finally, the detector is adjustable axially of the timing rotor by adjustment of the bracket part 78 vertically relative to the bracket arm 86.

These adjustments permit setting of the detector 14 in the proper timing element sensing position relative to the timing rotor 36, that is in the proper position relative to the rotor to sense the rotor timing elements or slots 46 in the proper timing relative to the reciprocating motion of the engine pistons as the timing rotor turns. Thus adjustment of the detector axially and radially of the rotor permits location of the detector in the proper sensing relation to the rotor wherein the rotor flange 42 passes between the detector light source 72 and light sensor 74. Adjustment of the detect or circumferentially of the rotor provides a timing adjustment for locating the detector in a position such that the timing pulses from the detector, produced by rotation of the rotor slots past the detector, occur in the proper timing relative to the reciprocating motion of the engine pistons.

It will now be understood that according to this invention, the breaker points and condensor of the conventional spark ignition system are removed from the distributor 10 and replaced by the timing rotor 36, mounting bracket 38 and detector 14. The rotor is mounted on the distributor cam 20 and the bracket 38 is adjusted to locate the detector 14 in the proper sensing relation relative to the rotor. As the rotor turns in unison with the engine crankshaft, the rotor timing elements or slots 46 rotate in succession between the detector light source 72 and light sensor 74, thereby causing the sensor to produce output pulses in timed relation to the reciprocating motion of the engine pistons. These pulses trigger the electronic ignition system of the engine between its conducting and non-conducting states to effect firing of the engine spark plugs in the proper timing relative to the reciprocating motion of the engine pistons.

Figure 10:
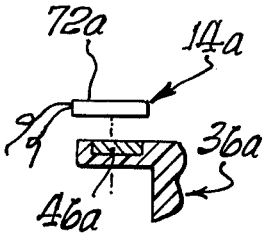
FIGS. 10 and 11 illustrate alternative timing element and sensing arrangements for timing the rotor and detector of the present distributor conversion means.
Figure 11:
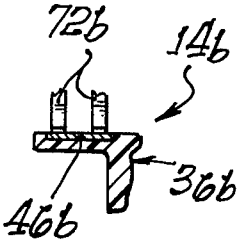

FIGS. 10 and 11 illustrate modified timing elements for the timing rotor and modified sensing arrangements for the timing element detector. In FIG. 10, the timing rotor **36*a* has timing elements 46*a* in the form of small permanent magnets recessed into the rotor flange 42. The timing element detector 14*a* comprises a reed switch 72*a* which is actuated between open and closed positions in response to rotation of the magnets past the switch. In FIG. 11, the timing rotor 36*b* has a timing element 46*b* in the form of a electrically conductive insert recessed into the motor flange. The timing element detector 14*b* comprises wiper contacts 72*b*** which simultaneously engage the insert, to complete an electrical circuit between the wiper contacts, as the inserts rotate past the contacts.

The inventor claims:

1. A universal retro-fittable ignition timing detector mounting bracket for an automotive ignition distributor of the kind having a body mounting a timing rotor with ignition timing elements uniformly spaced about its circumference and a timing element detector to be located in timing element sensing relation to the rotor wherein the detector senses and provides electrical ignition timing pulses in response to rotation of said timing elements past said detector, said bracket comprising:

a first relatively fixed base part including means for securing said part to the distributor body with a given axis of said part parallel to and spaced laterally from the turning axis of the timing rotor, a second relatively adjustable part for mounting said timing detector, and adjustable means movably mounting said second part on said first part for selective independent adjustment of the second part relative to the first part in both longitudinal directions of said given axis and any lateral direction of said given axis to permit selective adjustment of said detector axially, radially, and circumferentially of the timing rotor for locating said detector in timing element sensing relation to said rotor and in a selected position about the rotor axis, such that the detector provides said ignition signals in response to rotation of the rotor timing elements past a given point relative to the distributor body.

2. A mounting bracket according to claim 1, wherein: said adjustable means includes an adjustable screw and slot connection between said parts wherein the slot parallels said given axis for adjusting said second bracket part relative to said first bracket part longitudinally of said given axis to adjust said detector axially of the timing rotor.

3. A mounting bracket according to claim 1, wherein: said second bracket part is laterally spaced from said given axis, and said adjustable means includes means for pivotally adjusting said second part relative to said first part about said given axis to adjust said detector radially of said rotor.

4. A mounting bracket according to claim 1, wherein: said adjustable means includes means for adjusting said second bracket part toward and away from said given axis to adjust said detector circumferentially of the timing rotor.

5. A mounting bracket according to claim 1, wherein: said adjustable means includes an adjustable screw and slot connection between said parts wherein the slot parallels said given axis for adjusting said second bracket part relative to said first bracket part longitudinally of said given axis to adjust said detector axially of the timing rotor, means for pivotally adjusting said second part relative to said first part about said given axis to adjust said detector radially of said rotor, and means for adjusting said second bracket part toward and away from said given axis to adjust said detector circumferentially of the timing rotor.

6. A mounting bracket according to claim 1, wherein: said adjustable means comprises an arm disposed in a plane normal to said given axis, means mounting one end of said arm on said first bracket part for endwise adjustment of said arm relative to said first part to adjust said detector circumferentially of the timing rotor and for pivotal adjustment of the arm about said given axis to adjust said detector radially of the timing rotor, and means mounting said second part on the other end of said arm for adjustment relative to said arm in a direction parallel to said given axis to adjust said detector axially of the timing rotor.

7. A mounting bracket according to claim 6, wherein: said arm is generally curved, and said means mounting said arm on said first bracket part comprises a generally circularly curved longitudinal slot in said arm opening through the arm normal to said plane, and a bearing member fixed to said part and extending through said slot for pivotal adjustment of said arm about said bearing member and endwise adjustment of said arm relative to said bearing member.

8. A mounting bracket according to claim 6, wherein: said means for adjusting said second bracket part relative to said arm comprises an upstanding flange on said other arm end, and means securing said second part to said flange for adjustment relative to the flange parallel to said given axis.

9. A mounting bracket according to claim 6, wherein: said first bracket part has a lower base flange for seating against said distributor body, an opening through said flange to receive a fastener for securing said first part to said body and an upper arm supporting flange above and parallel to said base flange, said arm is generally curved, said means mounting said arm on said first part comprises a circularly curved longitudinal slot in said arm opening through the arm normal to said plane, and a bearing member fixed to said upper flange of said first part and extending through said slot for pivotal adjustment of said arm about said bearing member and endwise adjustment of said arm relative to said bearing member, and said means for adjusting said second bracket part relative to said arm comprises an upstanding flange on said other arm end, and means securing said second part to said arm flange for adjustment of said second part relative to the latter flange parallel to said given axis.

10. An electronic ignition distributor for a spark ignition engine comprising:

a distributor body, a timing rotor on said body having ignition timing elements uniformly spaced about its circumference, a timing element detector for sensing and providing electrical ignition timing signals in response to rotation of said timing elements with said rotor past said detector, means movably mounting said detector on said distributor body for selective independent adjustment of said detector relative to said body axially, radially, and circumferentially of said rotor to locate said detector in a timing element sensing position relative to said rotor, wherein said detector provides an electrical ignition timing signal in response to rotation of each rotor timing element past a predetermined point relative to said distributor body, and said mounting means comprising a universal retro-fittable detector mounting bracket including a first part fixed to said distributor body, a second part mounting said detector, and adjustable means movably mounting said second part on said first part for selective independent adjustment of said second part relative to said first part axially, radially, and circumferentially of said rotor.

11. A mounting bracket according to claim 10, wherein:

said adjustable means comprises an arm disposed in a plane normal to the rotor axis, and mounting at an end said second bracket part, means mounting the other end of said arm in said first bracket part for endwise adjustment of said arm relative to said first part along a generally circularly curved direction line in said plane to adjust said detector circumferentially of the timing rotor and for pivotal adjustment of the arm about an axis parallel to and spaced from said rotor axis to adjust said detector radially of the timing rotor, and means for adjusting said second part relative to said arm parallel to said rotor axis to adjust said detector axially of the timing rotor.

12. A mounting bracket according to claim 11, wherein:

said means mounting said arm on said first bracket part comprises a generally circularly curved slot in said arm extending lengthwise of the arm parallel to said direction line and opening through the arm parallel to said given axis, and a bearing member fixed to said first part and extending through said slot for pivotal adjustment of said arm about said bearing member and endwise adjustment of said arm relative to said bearing member.

13. A mounting bracket according to claim 12, wherein:

said means for adjusting said second bracket part relative to said arm comprises an upstanding flange on said one arm end, and means securing said second part to said flange for adjustment relative to the flange parallel to said given axis.

* * * * *